US006666343B1

(12) United States Patent
Liu

(10) Patent No.: US 6,666,343 B1
(45) Date of Patent: Dec. 23, 2003

(54) KNIFE RACK TO ATTACH TO A FREESTANDING GRILL

(76) Inventor: George C. M. Liu, No. 1-10, Hsing-Chung Rd., Tou-Nan Chen, Yunlin Hsien (TW)

( * ) Notice: Subject to any disclaimer, the term of this patent is extended or adjusted under 35 U.S.C. 154(b) by 0 days.

(21) Appl. No.: 10/241,579

(22) Filed: Sep. 12, 2002

(51) Int. Cl.[7] ..... A47F 7/00

(52) U.S. Cl. ..... 211/70.7; 248/37.3; D7/637; 126/9 B

(58) Field of Search ..... 211/70.7; 248/37.3, 248/37.6; 126/9 B; D7/637, 641

(56) References Cited

U.S. PATENT DOCUMENTS 4,071,212 A * 1/1978 Burrows et al. ..... 248/37.6
4,601,400 A * 7/1986 Buchanan et al. ..... 211/70.7
4,966,339 A * 10/1990 Lu ..... 211/70.7 X
D338,376 S * 8/1993 Ulber ..... D7/637
D366,990 S * 2/1996 Cheung ..... D7/637
6,142,140 A * 11/2000 Shumaker ..... 126/9 B
6,546,925 B1 * 4/2003 Wu ..... 126/9 B

* cited by examiner

*Primary Examiner*—Robert W Gibson, Jr.
(74) *Attorney, Agent, or Firm*—Bacon & Thomas, PLLC

(57) ABSTRACT

A knife rack to attach to a freestanding grill is made of metal plates comprises a front piece and a rear piece. The front piece includes a base, a vertical face and a horizontal face. Both the horizontal face and base are perpendicular to the base and extend to the rear piece. The rear piece is positioned under the horizontal face and includes a rear face with a top edge, a bottom edge, two sides, two parallel wings extending from opposite sides toward the front piece, a top lip and a bottom lip. The top lip is attached to the horizontal face. The bottom lip extends away from the front piece and has multiple holes so screws can fasten the bottom lip to a shelf of a grill. Multiple blade slots are defined through the horizontal face to hold the knives.

8 Claims, 3 Drawing Sheets

KNIFE RACK TO ATTACH TO A FREESTANDING GRILL

BACKGROUND OF THE INVENTION

1. Field of the Invention

The present invention relates to a knife rack, and more particularly to a knife rack that is securely attached to a freestanding grill.

2. Description of Related Art

Freestanding grills are widely used by American families. The food cooked on a grill is very delicious, and it is different from food prepared on other cooking appliances. However, since the grill can cook many different foods such as beef, ribs, fish, etc., people often have a need to use many different types of knives. For example, a butcher knife is used to cut beef, and a boning knife is used to cut ribs.

Keeping many different knives on the freestanding grill without a knife rack is potentially very dangerous and is inconvenient. Some people put a kitchen knife block on a shelf of the grill to hold the knives. Because the knife block is not attached to the shelf and the grill may be moved or knocked accidentally that results in vibrations, the knives may fall off the shelf of the grill. Falling knives are very dangerous and may injure somebody.

Another disadvantage of using knives without a knife rack attached to a freestanding grill is that the knives may clutter the shelf, and sometimes a knife might be mislaid or not readily accessible.

To overcome the shortcomings, the present invention provides a knife rack attached to a freestanding grill to mitigate and/or obviate the aforementioned problems.

SUMMARY OF THE INVENTION

The main objective of the present invention is to provide a knife rack to attach to a freestanding grill that will overcome the shortcomings of a conventional unattached knife block.

Another objective is to provide a knife rack to attach to a freestanding grill that has a simple structure, is easily made and is easy to use.

A further objective is to provide a knife rack to attach to a freestanding grill that will decrease the hazard to people associated with knives.

Other objects, advantages and novel features of the invention will become more apparent from the following detailed description when taken in conjunction with the accompanying drawings.

DETAILED DESCRIPTION OF PREFERRED EMBODIMENT

Figure 1:
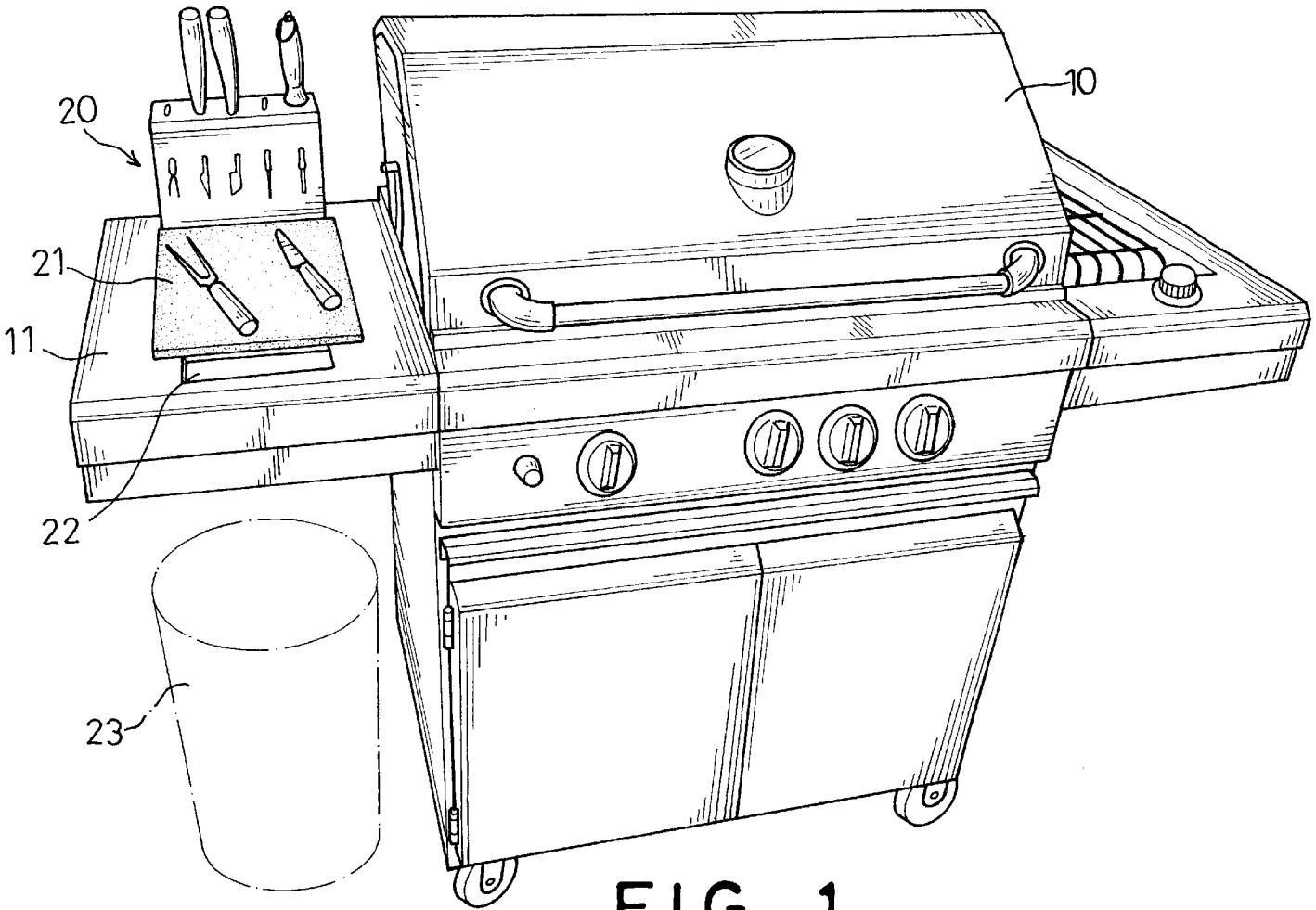
FIG. 1 is a perspective view of a knife rack in accordance with the present invention that is attached to a shelf on a freestanding grill.

With reference to FIG. 1, a type of freestanding grill has a body (10) with two sides (not numbered) and two shelves

(11) respectively attached to opposite sides of the body (10). A knife rack (20) in accordance with the present invention is attached to one of the shelves (11) to hold knives such as a butcher knife, a cleaver, a sharpener, etc. A cutting board (21) is placed on the shelf (11) so that a person can cut food on the shelf (11). A hole (22) is defined on the shelf (11) next to the cutting board (21) so garbage can be scraped easily off the cutting board (21) and the shelf (11). A garbage can (23) is placed under the hole (22) to catch garbage that passes through the hole (22).

Figure 2:
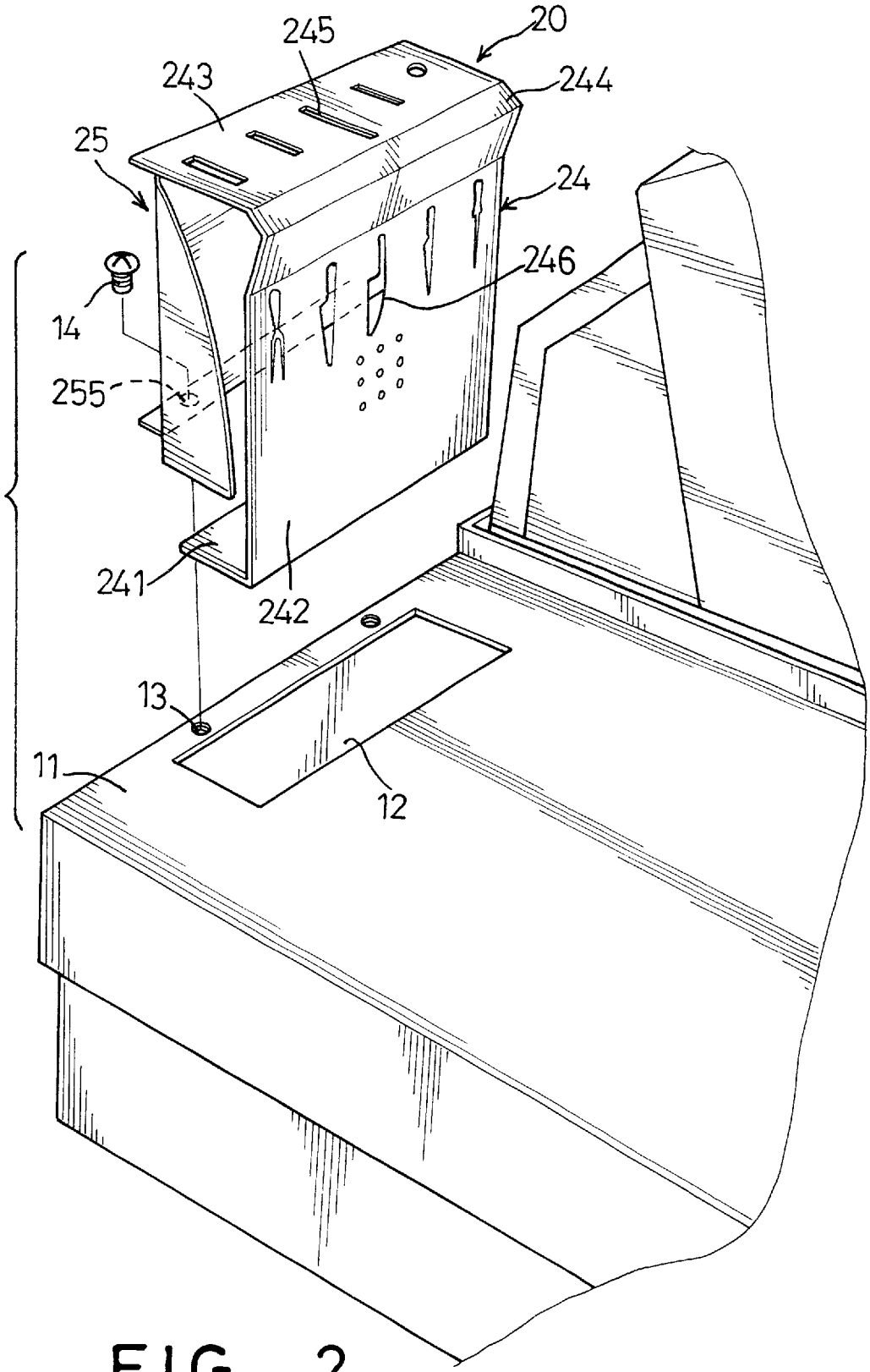
FIG. 2 is an exploded perspective view of the knife rack in FIG. 1 showing the relationship between the knife rack and the shelf.
Figure 3:
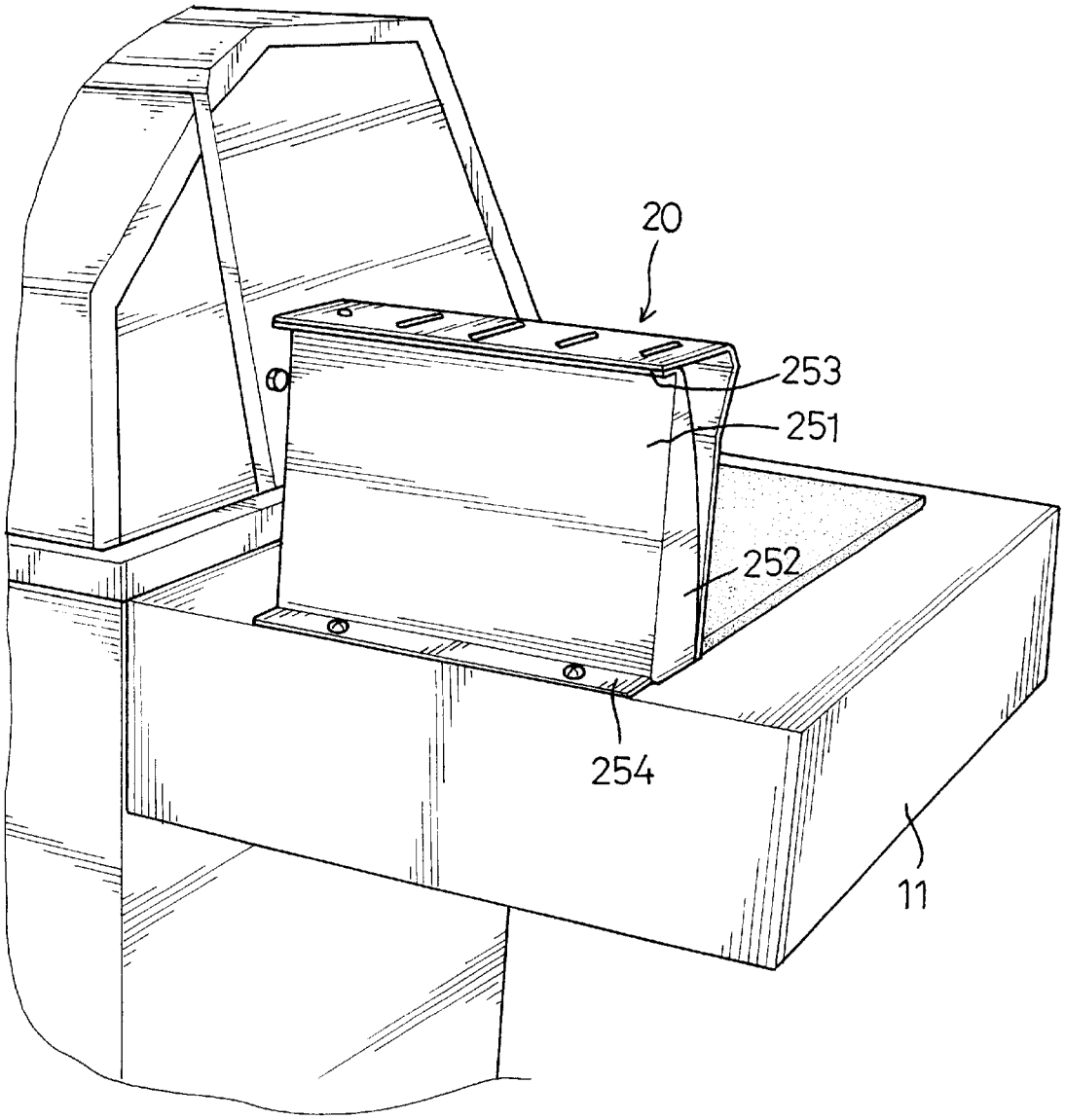
FIG. 3 is a perspective view of the knife rack in FIG. 2 when viewed from the back.

With further reference to FIGS. 2 and 3, the knife rack (20) is made of bendable metal plates or sheet metal and comprises a front piece (24) and a rear piece (25). Prior to formation of the front piece (24) to its final form, the front piece (24) is rectangular with a top edge, a bottom edge and two sides. The rectangular front piece (24) is bent to form a base (241) along the bottom edge, a horizontal face (243) along the top edge and a vertical face (242). The vertical face (242) has a top edge, a bottom edge, a front, a back and two sides and is formed between the base (241) and the horizontal face (243). The base (241) and the horizontal face (243) are perpendicular to the vertical face (242) and extend toward the rear piece (25). A V-shaped crease (244) is formed in the top of the vertical face (242) at a bend forming the horizontal face (243) and the vertical face (242) by a sheet metal brake, a plate bending machine or other means. Both the base (241) and horizontal face (243) extend toward the rear piece (25). The V-shaped crease (244) increases the strength of the vertical face (242).

Multiple blade slots (245) are defined through the horizontal face (243), and the blade slots (245) are formed in shapes corresponding to cross sectional shapes of the knife blades. A silhouette (246) corresponding to each blade slot (245) and the knife or tool intended to be stored in the particular blade slot (245) is defined in the vertical face (242). The silhouette (246) assists a user in easily distinguishing the position of a particular knife or tool in the knife rack (20).

The rear piece (25) is positioned under the horizontal face (243) and has a rear face (251) with a top edge, a bottom edge, two sides and two parallel wings (252). The top edge and-the bottom edge are parallel. The wings (252) are formed respectively on opposite sides of and perpendicular to the rear face (251) and extend toward the vertical face (242) of the front piece (24). A top lip (253) and a bottom lip (254) are defined respectively at the top and bottom edges of the rear face (251) and extend away from the front piece (24) perpendicular to the rear face (251). Multiple holes (255) are defined in the bottom lip (254) to attach the knife rack (20) to the shelf (11). The top lip (253) is aligned with and attached to the horizontal face (243) by welding or other means of securely fastening the elements together.

However, to attach the knife rack (20) to the shelf (11) easily and securely, a recess (12) corresponding to the base (241) is defined in the shelf (11) to hold the base (241) of the knife rack (20) so that the knife rack (20) can stand in the recess (20). Multiple screw holes (13) corresponding to the holes (255) in the bottom lip (254) are defined in the shelf (11).

Hence, the installation of the knife rack (20) is very easy and simple. The knife rack (20) can be attached to the shelf (11) by passing a screw (14) through the hole (255) and screwing the screw (14) into the screw hole (13) thereby securely fastening the knife rack (20) to the shelf (11).

From the foregoing description, one should note that the invention has the following advantages:

1. Simple Structure:

Because the knife rack is made of metal plates and its structure is very simple, the manufacturer is able to produce the product at a lower cost.

2. Easy Installation:

A minimum of two screws can securely attach the knife rack to the shelf. Therefore, a DIY user does not have to spend excessive time to install the invention.

3. Safe and Convenient Use:

Knives are safely stored and easily accessed when needed due to the silhouette design. People should never select an incorrect knife unless it was improperly stored initially. When the knifes are held in the knife rack, the two parallel wings, the vertical face and the rear face can prevent anyone from contacting with the blade of the knife so that the safety of using the knives is improved.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A knife rack to attach to a freestanding grill having a shelf with a recess, the knife rack comprising:

a rear piece adapted to be secured on the shelf of the freestanding grill and having a rear face with a top edge, a bottom edge, two sides and two parallel wings respectively formed on opposite sides, a bottom lip formed at the bottom edge of the rear piece and perpendicular to the rear face, and multiple holes defined on the bottom lip of the rear piece; and a front piece securely connected to the top edge of the rear piece and comprising:

a vertical face having a top edge and a bottom edge; and a horizontal face formed at the top edge of the front piece and securely connected to the top edge of the rear piece, and multiple blade slots defined in the horizontal face;

wherein the parallel wings extend toward the front piece.

2. The knife rack as claimed in claim 1, wherein a base adapted for being held in the recess in the shelf of the freestanding grill is formed at the bottom edge of the vertical face, and the base is perpendicular to the vertical face; and a top lip is formed on the top edge of the rear face and the top lip is securely attached to the horizontal face.

3. The knife rack as claimed in claim 1, wherein a V-shaped crease is formed between the horizontal face and the vertical face.

4. The knife rack as claimed in claim 1, wherein multiple silhouettes corresponding to the blade slots are defined on the vertical face.

5. The knife rack as claimed in claim 2, wherein a V-shaped crease is formed between the horizontal face and the vertical face.

6. The knife rack as claimed in claim 2, wherein multiple silhouettes corresponding to the blade slots are defined on the vertical face.

7. The knife rack as claimed in claim 3, wherein multiple silhouettes corresponding to the blade slots are defined on the vertical face.

8. The knife rack as claimed in claim 5, wherein multiple silhouettes corresponding to the blade slots are defined on the vertical face.

* * * * *